US009962845B2

(12) United States Patent
McCormick

(10) Patent No.: US 9,962,845 B2
(45) Date of Patent: May 8, 2018

(54) SYSTEM AND METHOD FOR TAPERED CUTTER GUIDE FOR CUTTING QUILTING PIECES AND PAPER PIECING

(71) Applicant: CM Designs, Inc., Franktown, CO (US)

(72) Inventor: Carolyn D McCormick, Franktown, CO (US)

( * ) Notice: Subject to any disclaimer, the term of this patent is extended or adjusted under 35 U.S.C. 154(b) by 127 days.

(21) Appl. No.: 15/071,972

(22) Filed: Mar. 16, 2016

(65) Prior Publication Data

US 2016/0279819 A1 Sep. 29, 2016

Related U.S. Application Data

(60) Provisional application No. 62/139,553, filed on Mar. 27, 2015.

(51) Int. Cl.

| | |
|---|---|
| ***A41H 3/00*** | (2006.01) |
| ***B26B 25/00*** | (2006.01) |
| ***B26B 29/06*** | (2006.01) |
| ***D05B 97/12*** | (2006.01) |

(52) U.S. Cl.
CPC ..... *B26B 25/005* (2013.01); *B26B 29/06* (2013.01); *D05B 97/12* (2013.01)

(58) Field of Classification Search
CPC ..... B26B 25/005; B26B 29/06
USPC ..... 30/315, 164.95; 33/42, 485, 489, 562, 33/566, 18.1, 27.12
See application file for complete search history.

(56) References Cited

U.S. PATENT DOCUMENTS

| | | | | |
|---|---|---|---|---|
| 3,406,456 | A * | 10/1968 | Schleich | B26B 29/06 33/492 |
| 5,579,670 | A | 12/1996 | McCormick | |
| 5,823,086 | A | 10/1998 | McCormick | |
| 6,782,629 | B2 * | 8/2004 | Jimenez | B43L 7/005 33/483 |
| 6,925,724 | B2 | 8/2005 | Tandy | |
| 7,854,073 | B1 | 12/2010 | Webb | |
| 8,011,111 | B2 * | 9/2011 | Brady | B26B 29/06 33/494 |
| D670,181 | S * | 11/2012 | Allemand | D10/71 |
| 8,397,396 | B2 | 3/2013 | Nethery | |
| 2004/0231173 | A1 * | 11/2004 | Baker | B26B 29/06 33/42 |
| 2006/0174504 | A1 * | 8/2006 | Szumer | B25H 7/02 33/613 |

(Continued)

*Primary Examiner* — Omar Flores Sanchez
(74) *Attorney, Agent, or Firm* — Daniel W. Roberts; Law Offices of Daniel W. Roberts, LLC

(57) ABSTRACT

The tapered cutter guide includes a generally rectangular body having a long first edge and opposite thereto a long second edge. A depending rail is positioned along the first edge of the tapered cutter guide, the rail having an inner guide edge and an outer cutting edge with the inner guide edge and the outer cutting edge being spaced apart in parallel relation by a width selected to correspond to a desired sewing expanse. A tapered section is provided along the second edge to provide a sharp edge of the tapered cutter guide opposite from the first edge, the tapered section rising at an acute angle from the sharp edge towards the inner guide edge. There is also a flat top section between the first and second edge, and a flat inner section parallel to the top section adjoining the inner edge to the tapering section. An associated method of use is also provided.

22 Claims, 6 Drawing Sheets

(56) References Cited

U.S. PATENT DOCUMENTS

| | | | | |
|---|---|---|---|---|
| 2009/0293697 | A1* | 12/2009 | Wei | B26B 29/06 83/745 |
| 2011/0247221 | A1* | 10/2011 | Elardo | B26B 29/06 30/290 |
| 2017/0225346 | A1* | 8/2017 | Holtgreive | B26B 29/06 |

* cited by examiner

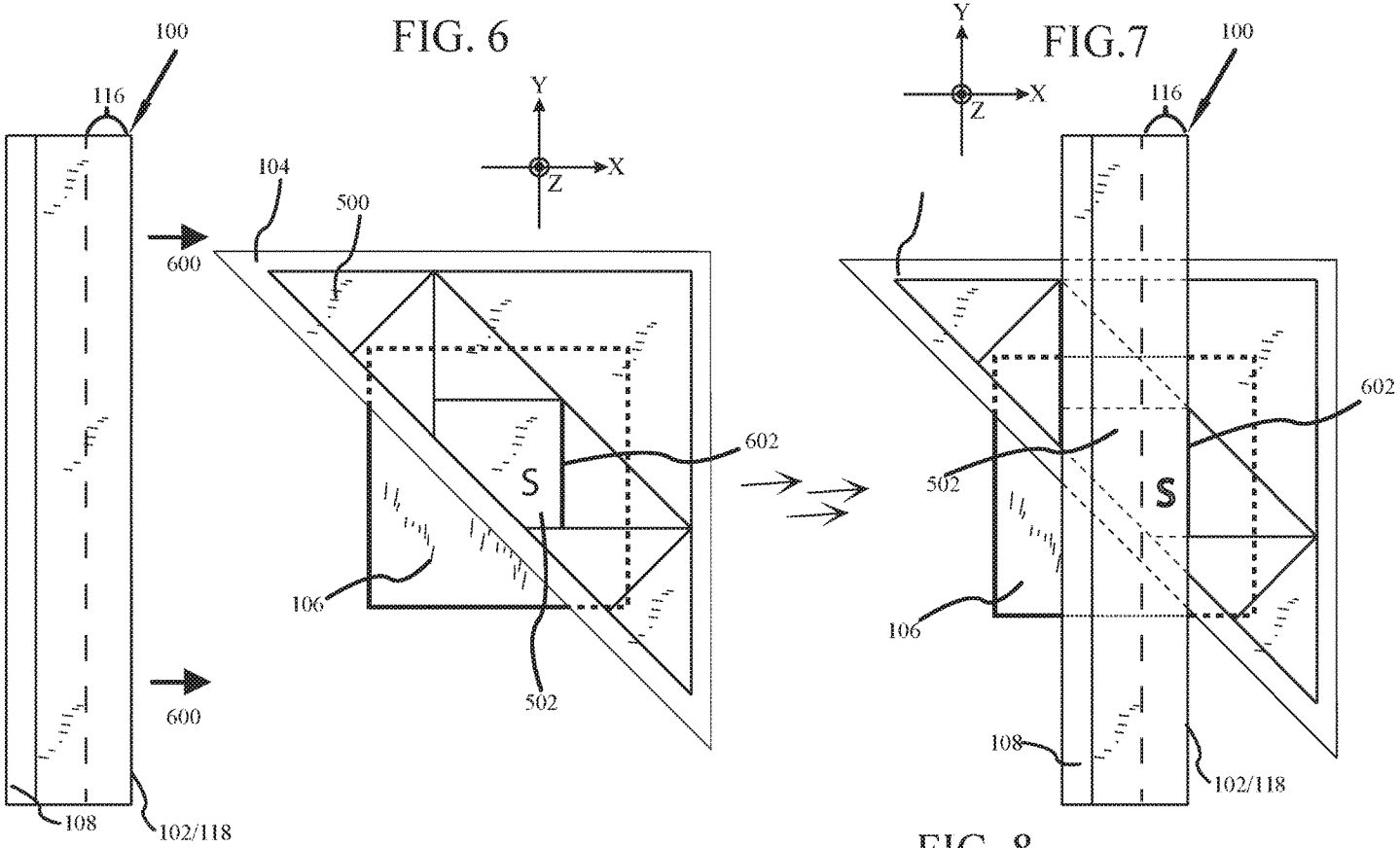
FIG. 6
FIG.7
100
116
102/118
108
104
106
500
502
600
602
S
X
Y
Z
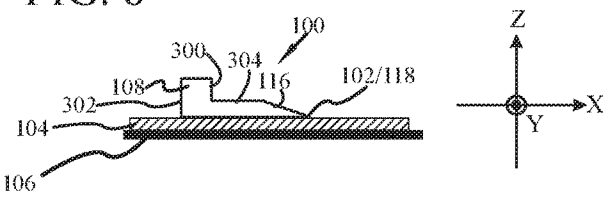
FIG. 8
100
102/118
116
304
300
108
302
104
106
X
Y
Z

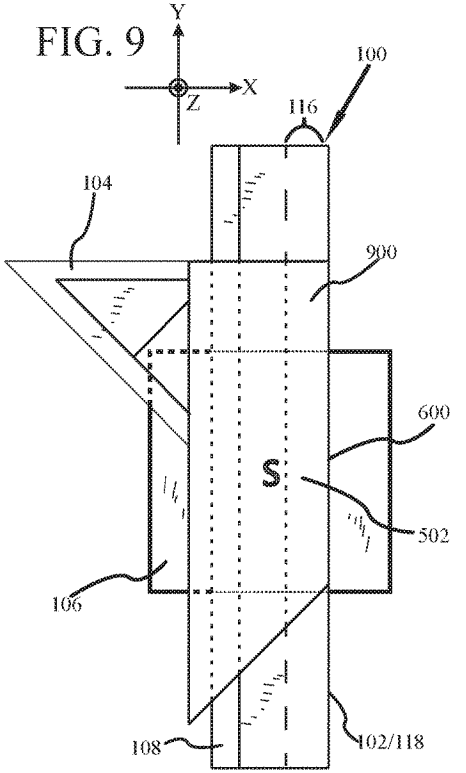
FIG. 9
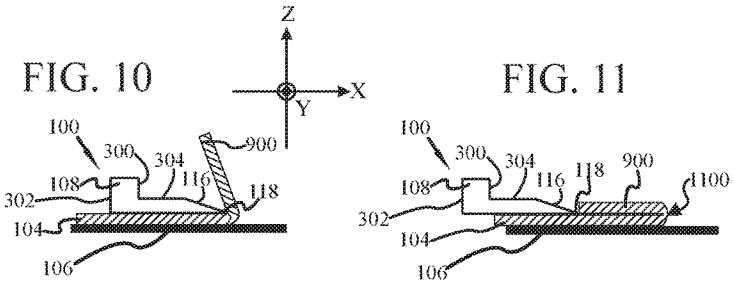
FIG. 11
FIG. 10
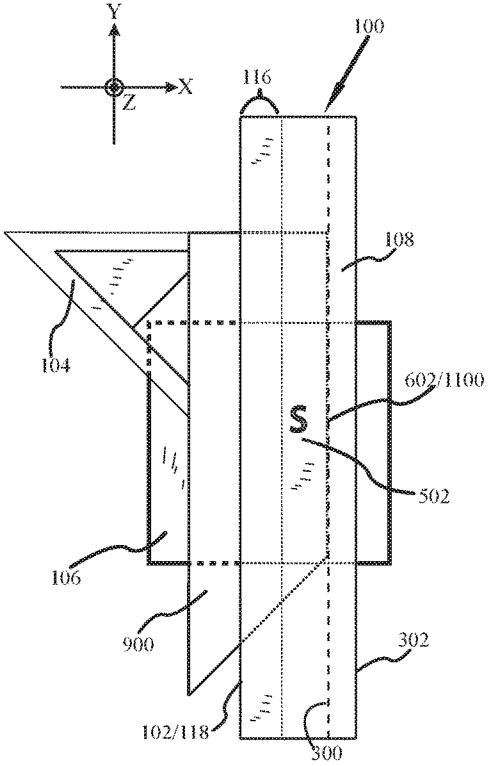
FIG. 12
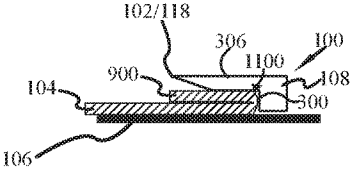
FIG. 13

SYSTEM AND METHOD FOR TAPERED CUTTER GUIDE FOR CUTTING QUILTING PIECES AND PAPER PIECING

CROSS REFERENCE TO RELATED APPLICATIONS

This application claims the benefit under 35 U.S.C. § 119(e) of U.S. Provisional Application No. 62/139,553 filed Mar. 27, 2015 and entitled SYSTEM AND METHOD FOR TAPERED CUTTER GUIDE FOR CUTTING QUILTING PIECES AND PAPER PIECING, the disclosure of which is incorporated herein by reference.

FIELD OF THE INVENTION

The present invention relates generally to the field of quilting, and more specifically to paper piecing—specifically a system and method incorporating a tapered cutter guide for establishing fabric pieces properly sized to a paper piece template with a sewing expanse of consistent width around each fabric piece.

BACKGROUND

Quilting requires precision sewing to fit all the various pieces of a pattern together. Each quilting piece must be provided with a sewing expanse on each edge of the quilting piece to allow for sewing the quilting pieces together to form a quilt. Conventionally, seamstresses mark on the fabric a cutting line that is separated from the sewing line of the quilting piece by about ¼ inch. The fabric is then cut along the cutting line and the cut out piece now has the quilting piece surrounded by a sewing expanse to allow for sewing the quilting pieces together.

Mechanical means for marking a line spaced apart a fixed distance from a master pattern is known. See for example, U.S. Pat. No. 2,215,499 to Glick. A device for sewing a hem on a window shade a fixed distance from an edge is shown in U.S. Pat. No. 3,352,466 to McAllister. Neither of these devices, however, could be used to cut a quilting piece so that the quilting piece has a sewing expanse for sewing the quilt pieces together.

Various options have been known and developed for enabling a person to take a pattern and develop a quilt. While in perhaps the most simple form, various extra pieces of cloth are simply stitched together; it is often desired by the quilter to develop a specific design, such as a picture or pattern. It is not uncommon for such pictures or patterns to be complex, and indeed if each piece of the quilt is not properly sized and aligned the end product may be less than desired.

For some patterns, the pattern template is placed upon a piece of desired fabric and a cutter guide is then used to cut out the appropriate quilt piece. In some cases, a cutter guide may be used that has an additional margin incorporated so as to provide a proper sewing expanse for the quilt piece. U.S. Pat. No. 5,579,670 and U.S. Pat. No. 5,823,086 are cutter guides developed by the present applicant and which incorporate this additional margin so a to simplify the task of accounting for the sewing expanse when cutting out quilting pieces.

Paper piecing, also referred to as foundation piecing, is a variant of the quilting process and is growing in popularity. Using a paper pattern and stitching directly through the paper may simplify a very detailed quilting project. Although foundation piecing has been known for a long time, the evolution to paper piecing as a specific type of foundation piecing has rapidly grown in popularity recently.

Indeed paper piecing can be a very effective technique for handling odd angles and very small pieces of fabric that do not lend themselves well to traditional template piecing. With paper piecing, it is a common task to fold the pattern back upon itself along a seam line. This folding helps to establish straight, crisp lines that facilitate straight line sewing. Folding of the pattern is not an element of traditional template piecing, as the template is not sewn to the fabric.

Moreover, paper piecing is a great quilting option for beginners as well as for experienced quilters. One can make a wonderful quilt on their very first try since complicated patters are broken down into easily managed steps. Sewing the fabric to the paper makes matching points relatively easy and the paper stabilizes the fabric, enabling one to use even the smallest of fabric scraps.

Typically, in paper piecing, which is also known in the art as foundation piecing, the pattern of the intended quilt consists of a plurality of geometric shapes, each having straight edges. An oversized fabric piece is disposed under an intended shape such that the fabric extends beyond the edges of the shape. The paper pattern is folded back upon itself along each line of the shape in turn. This element of folding makes traditional template piecing guides of little use with respect to the folding process.

Moreover, a thin card is placed along a selected line and the paper template is folded back over the card—the edge of the card providing an abutment to ensure a straight and crisp crease directly upon the line. With the pattern now folded, the excess fabric material exposed by the fold may be trimmed to the proper width. This process is performed for each line of each piece.

Of course this requires a collection of tools—a card for the folding and a gage for establishing the sewing margin and a trimmer, at the very least. Keeping track of tools can be a challenge if the quilting project involves large amounts of fabric which may inadvertently cover a tool, or if the quilting project is being worked on in an environment where extra space is limited.

Hence there is a need for a method and system that is capable of overcoming one or more of the above identified challenges.

SUMMARY OF THE INVENTION

Our invention solves the problems of the prior art by providing novel systems and methods for a singular device that advantageously provides both a tapered cutter guide for establishing a proper and consistent sewing expanse around a quilting piece and a sharp, tapered edge for assisting in folding a paper template that is common in paper piece quilting.

In particular and by way of example only, according to one embodiment of the present invention, provided is a tapered cutter guide for use in cutting quilting pieces and paper piecing, including: a generally rectangular body having a long first edge and opposite thereto a long second edge; a depending rail positioned along the first edge of the tapered cutter guide, the rail having an inner guide edge and an outer cutting edge with the inner guide edge and the outer cutting edge being spaced apart in parallel relation by a width selected to correspond to a desired sewing expanse; a tapered section along the second edge to provide a sharp edge of the tapered cutter guide opposite from the first edge, the tapered section rising at an acute angle from the sharp edge towards the inner guide edge; and a flat top section between the first and second edge, and a flat inner section parallel to the top section adjoining the inner edge to the tapering section.

In yet another embodiment, provided is a system for cutting fabric quilting pieces having an exposed area with a tapered cutter guide, the system including a quilt pattern providing a plurality of geometric shapes, each shape having straight sides and each shape representing a quilting piece; a tapered cutter guide having: a depending rail positioned along a first edge of the tapered cutter guide, the rail having an inner guide edge and an outer cutting edge with the inner guide edge and the outer cutting edge being spaced apart in parallel relation by a width selected to correspond to a desired sewing expanse; a tapered section along a second sharp edge of the tapered cutter guide opposite from the first edge, the tapering section rising at an angle from the sharp edge towards the inner guide edge; and a flat top section between the first and second edge, and a flat inner section parallel to the top section adjoining the inner edge to the tapering section; and a cutter for cutting the fabric; wherein the flat top section of the tapered cutter guide is disposed upon the pattern with the sharp edge disposed along the straight edge of a selected shape, the pattern folded about the sharp edge to impart a crease along the selected line of the pattern; wherein the tapered cutter guide is removed and the inner guide edge of the tapered cutter guide is positioned on, and in stationary relation to, the crease of the pattern; and wherein the cutter is moved along and is guided by the outer cutting edge of the rail to cut the fabric into a quilting piece expanded in size by the desired sewing expanse.

And for yet another embodiment, provided is a method for cutting fabric quilting pieces having an exposed area with a tapered cutter guide, including: disposing a quilt pattern providing a plurality of geometric shapes upon a piece of fabric, each shape having straight sides and each shape representing a quilting piece; the disposed pattern aligning a selected geometric shape to the piece of fabric; providing a cutter for cutting the fabric; providing a tapered cutter guide having: a depending rail positioned along a first edge of the tapered cutter guide, the rail having an inner guide edge and an outer cutting edge with the inner guide edge and the outer cutting edge being spaced apart in parallel relation by a width selected to correspond to a desired sewing expanse; a tapered section along a second sharp edge of the tapered cutter guide opposite from the first edge, the tapering section rising at an angle from the sharp edge towards the inner guide edge; and a flat top section between the first and second edge, and a flat inner section parallel to the top section adjoining the inner edge to the tapering section; wherein the flat top section of the tapered cutter guide is disposed upon the pattern with the sharp edge disposed along a selected line of the selected shape, the pattern folded about the sharp edge to impart a crease along the selected line of the pattern; wherein the tapered cutter guide is removed and the inner guide edge of the tapered cutter guide is positioned on and in stationary relation to the crease of the pattern; and wherein the cutter is moved along and is guided by the outer cutting edge of the rail to cut the fabric into a quilting piece expanded in size by the desired sewing expanse.

BRIEF DESCRIPTION OF THE DRAWINGS

FIGS. 6-7 are top views showing the fabric beneath the paper template and the tapered cutter guide being positioned in accordance with at least one embodiment;

FIG. 8 is a side view showing the vertical arrangement of the fabric, paper template and tapered cutter guide in accordance with at least one embodiment;

FIG. 9 is a further top view showing the paper template folded back around the tapered edge of the tapered cutter guide in accordance with at least one embodiment;

FIGS. 10-11 are side views further illustrating the paper template folding about the tapered edge of the tapered cutter guide to provide a crease in accordance with at least one embodiment, FIG. 12 is a top view showing the tapered cutter guide repositioned now along the creased fold of the paper template so as to provide a cutter guide for trimming the fabric to establish a consistent sewing expanse in accordance with at least one embodiment;

FIG. 13 is a side view further illustrating the vertical arrangement of the fabric, paper patter and tapered cutter guide for establishing the sewing expanse in accordance with at least one embodiment;

DETAILED DESCRIPTION

Before proceeding with the detailed description, it is to be appreciated that the present teaching is by way of example only, not by limitation. The concepts herein are not limited to use or application with a specific system or method for a tapered cutter guide system for cutting quilting pieces and paper piecing, also known as foundation piecing. Thus although the instrumentalities described herein are for the convenience of explanation shown and described with respect to exemplary embodiments, it will be understood and appreciated that the principles herein may be applied equally in other types of systems and methods involving a tapered cutter guide system for cutting quilting pieces and paper piecing.

Figure 1:
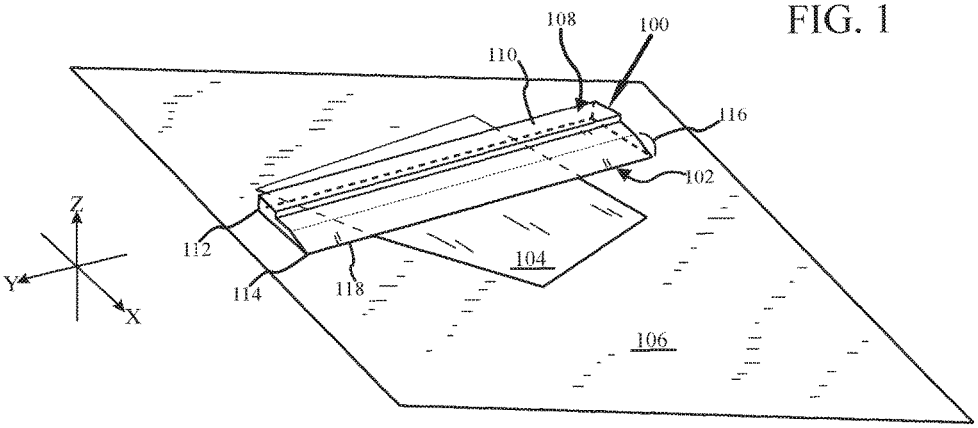
FIG. 1 is a perspective view of an improved system for a tapered cutter guide for folding a paper template in paper piece quilting in accordance with at least on embodiment.
Figure 2:
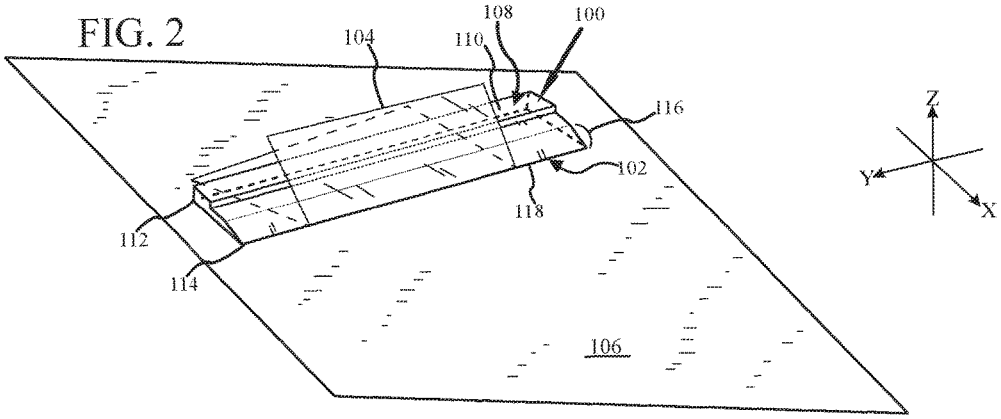
FIG. 2 is a perspective view of the paper pattern shown in FIG. 1 being folded about the tapered cutter guide in accordance with at least on embodiment.

Turning to FIG. 1, there is shown a tapered cutter guide 100 with tapered edge 102 disposed upon a paper template 104 which in turn is disposed upon a piece of fabric 106. As will be discussed further below, tapered cutter guide 100 also has a depending rail 108. As shown in FIG. 2, the paper template 104 is folded over the tapered edge 102 of the tapered cutter guide 100 and towards the depending rail 108, which is currently extending away from the fabric 106.

To facilitate the description of systems and methods for this tapered cutter guide 100, the orientation of tapered cutter guide 100 as presented in the figures are referenced to the coordinate system with three axes orthogonal to one another as shown in FIG. 1. The axes intersect mutually at the origin of the coordinate system, which is chosen to be the center of the tapered cutter guide 100, however the axes shown in all figures are offset from their actual locations for clarity and ease of illustration.

The tapered cutter guide 100 is similar to those previously developed by applicant and now known as U.S. Pat. No. 5,579,670 and U.S. Pat. No. 5,823,086, each incorporated herein by reference. However the tapered cutter guide 100 of the present invention has a specifically tapered edge 102 not present in either the '670 or '086 patents—each of which has a thick blunt edge opposite from the cutter guide, the thick blunt edge being unsuitable for establishing a proper paper fold.

More specifically, as shown the tapered cutter guide 100 is generally a straight edge. More specifically, for at least one embodiment, the tapered cutter guide 100 has a generally rectangular body 110 having a long first edge 112 and opposite thereto a long second edge 114. A depending rail 108 is positioned along the first edge 112. A tapered edge 102 is provided by a tapered section 116 along the second edge 114, the tapered section 116 rising at an acute angle from a sharp edge 118 towards the depending rail 108. Of course other shapes of cutter guides could be used just as effectively for applications where a curve in the eventual quilt is desired.

Figure 3:
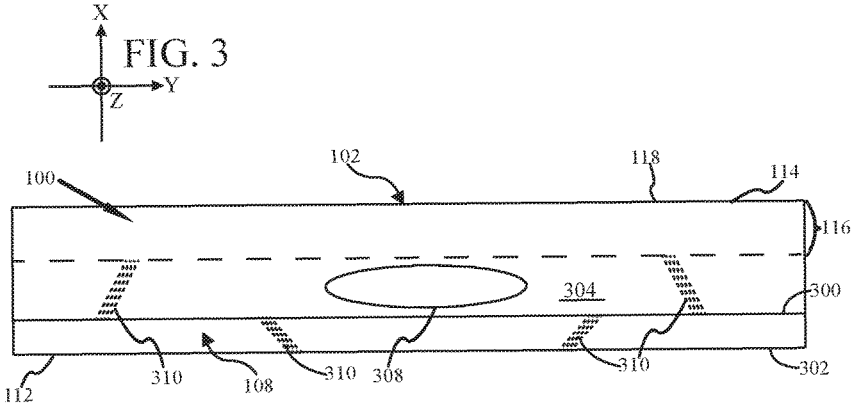
FIG. 3 is a bottom view of the tapered cutter guide in accordance with at least on embodiment.
Figure 4:
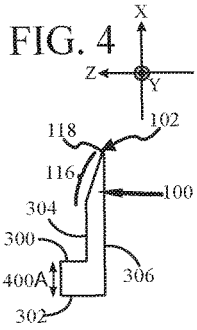
FIG. 4 is a side view of the tapered cutter guide in accordance with at least on embodiment.

These advantages are more fully appreciated with respect to FIGS. 3 and 4 showing a bottom view and side view of the tapered cutter guide 100. As is shown clearly in FIGS. 3 and 4, the tapered cutter guide 100 has a depending rail 108. The width A 400 of this rail is selected to correspond to the desired sewing expanse. This depending rail 108 provides an inner guide edge 300 and an outer cutting edge 302.

Opposite from this rail is the tapered section 116 of the tapered cutter guide 100. More specifically, as the rail is along a first edge, i.e. the outer cutting edge 302, of the tapered cutter guide 100, a tapered section 116 is provided along the second edge 114, e.g. sharp edge 118 opposite from the outer cutting edge 302.

As is perhaps best perceived in FIG. 4, this tapered section 116 extends from the second edge 114, e.g. sharp edge 118, towards the inner edge 300 and a flat inner section 304 adjoins the inner edge 300 to the tapered section 116. A top flat section 306 generally parallels the flat inner section 304 and adjoins the outer edge 302 and the second edge 114, e.g. sharp edge 118. Indeed it is the top flat section 306 and the tapered section 116 that define the acute angle that accounts for the second edge 114, e.g. sharp edge 118.

As shown in FIGS. 1 and 2, when used for advantageous folding of the paper template 104, the tapered cutter guide 100 is disposed with this top flat section 306 against the paper template 104. As the tapered section 116 rises from the second edge 114, e.g. sharp edge 118 towards the inner edge 300 there is a convenient surface upon which the paper template 104 may be folded.

Further, the second edge 114, e.g. sharp edge 118 provides a specific and advantageous structure about which the paper template 104 may be folded, which far exceeds the block end of a conventional quilting guide. When used as a cutter guide, this flat inner section 304 ensures that the tapered cutter guide 100 is well seated and aligned to the template 104 thus permitting the user to cut the fabric 106 simply and efficiently.

Moreover, for at least one embodiment, the tapered cutter guide 100 may be summarized as a generally rectangular body 110 having a long first edge 112 and opposite thereto a long second edge 114; a depending rail 108 is positioned along the first edge 112 of the cutter guide 100, the depending rail 108 having an inner guide edge 300 and an outer cutting edge 302 with the inner guide edge 300 and the outer cutting edge 302 being spaced apart in parallel relation by a width A 400 selected to correspond to a desired sewing expanse; a tapered section 116 along the second edge 114 to provide a sharp edge 118 of the cutter guide 100 opposite from the first edge 112, the tapering section 116 rising at an angle from the second edge 114, e.g. sharp edge 118 towards the inner guide edge 300; and a flat top section 306 between the first edge 112 and second edge 114, and a flat inner section 304 parallel to the top section 306 adjoining the inner edge 300 to the tapered section 116.

For at least one embodiment the tapered cutter guide 100 is made of a substantially transparent material such that the seamstress can observe the paper template 104 directly through the material of the tapered cutter guide 100. For other embodiments, the substantially transparent material may be colored, such that the tapered cutter guide 100 can be easily seen, yet still seen through. Further, the tapered cutter guide 100 may also be marked with standard measurement units (not shown).

For yet another embodiment, a portion of the tapered cutter guide 100 may include at least one magnification lens 308. This lens may be formed as a portion of the top surface 306, the inner flat surface 304, or otherwise established within the body 110 of the tapered cutter guide 100. Further still, the top section adjacent to the rail section may be rendered slightly opaque so as to make the rail section more visually apparent.

Yet further embodiments may provide a texture 110 to the top surface 306 and or the inner flat section 304, and or the depending rail 108 to assist with it being placed by hand, and or to provide an improved friction hold upon the paper and or fabric 106 during the quilting process. The tapered cutter guide 100 may further provide a hole for easy storage by hanging.

Moreover the tapered cutter guide 100 provides at least two advantageous elements in a single tool, thus eliminating at least one additional element as is typically required in paper piecing a quilting. Specifically the tapered cutter guide 100 provides both a cutter guide, i.e. the outer edge 302, and a sharp edge 118 against which the paper template 104 is folded. These elements may be more fully appreciated with respect to the FIGS. 5-18.

Figure 5:
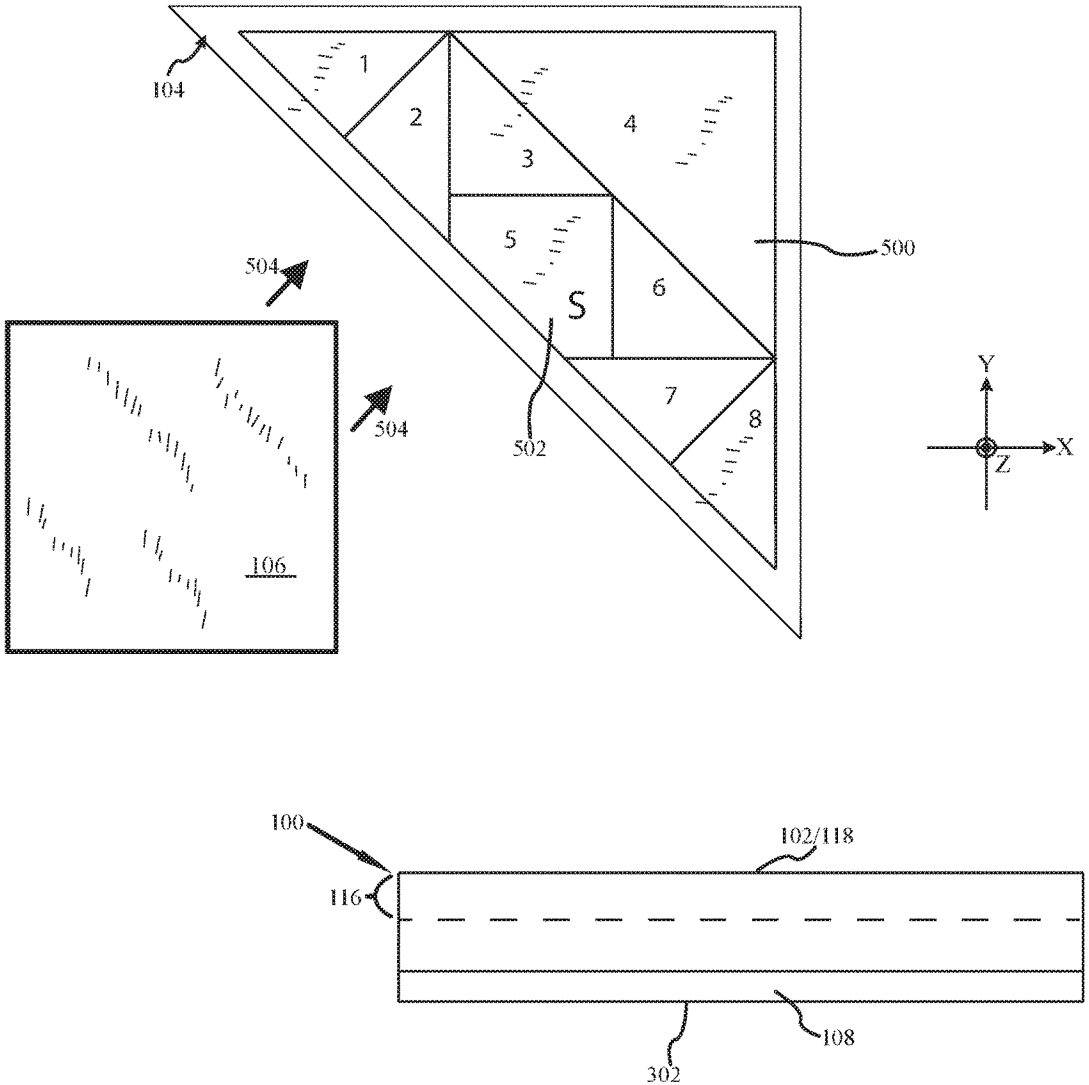
FIG. 5 is a top view of a paper pattern, fabric and a template and cutter guide in accordance with at least one embodiment.
Figure 15:
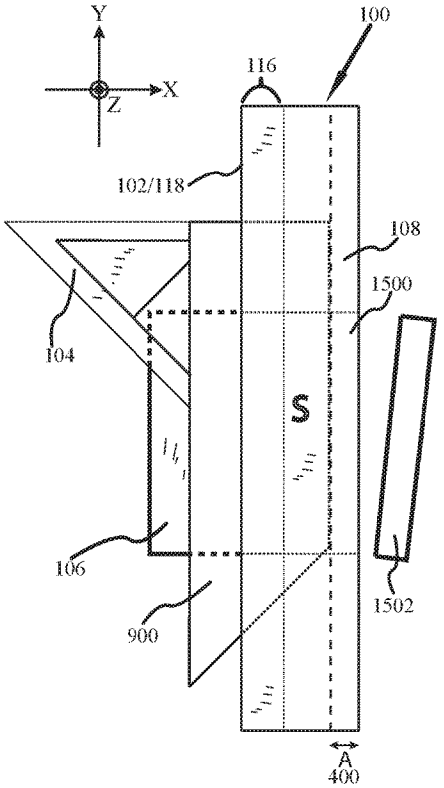
FIG. 15 is a top view showing the result of the fabric trimming to establish the sewing expanse in accordance with at least one embodiment.
Figure 16:
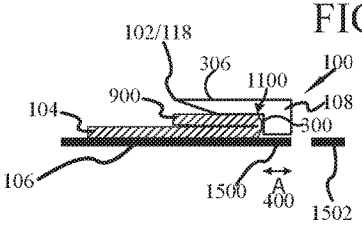
FIG. 16 is a side view showing the result of the fabric trimming to establish the sewing expanse in accordance with at least one embodiment.

FIG. 5 illustrates a paper pattern 104, also known and referred to herein as a paper template 104, a fabric 106 piece and a tapered cutting guide in accordance with at least one embedment. The paper template 104 is appreciated to have a plurality of geometric shapes 500, such as shapes 1-8, which correspond to desired shapes in the quilt to be sewn. Moreover each shape corresponds to a different piece of fabric 106 in the resulting quilt. For such assembly to occur, each piece of fabric 106 must be trimmed to an appropriate size, corresponding to the intended shape and providing the sewing expanse so that the individual pieces of fabric 106 may be properly sewn together.

For the present example Shape S 502 is the intended quilt element to be established. As shown by the arrows 504, the fabric 106 is to be disposed under the paper template 104, and in general alignment to Shape S 502. Removable tape or pins may be used to further secure the fabric 106 piece to the paper template 104 until such time as sewing commences.

In FIG. 6 the fabric 106 piece is shown disposed beneath at least a portion of the paper template 104 and most specifically below Shape S 502. As is further illustrated, the tapered cutter guide 100 is moved into position as shown by the arrows 600 so as to place the tapered edge 102, e.g. sharp edge 118 upon first line 602 of Shape S 502, resulting in the configuration shown in FIG. 7.

As shown in FIG. 7 the tapered edge 102 of the tapered cutter guide 100 is in precise alignment with a first line 602 of Shape S 502. The vertical arrangement of the tapered cutting guide, the paper template 104 and the fabric 106 is shown in FIG. 8.

The portion 900 of the paper template 104 to the right of the tapered cutter guide 100, i.e., to the right of the first line, is now folded over the sharp edge 118 and tapered portion 116 of the tapered cutter guide 100 as shown in FIG. 9. This folding process may be more fully appreciated with respect to FIGS. 10 and 11. Moreover, it is appreciated that the paper template 104 is folded crisply and sharply back on itself to form a desired crease, e.g. creased fold 1100 shown in FIG. 11.

This creased fold 1100 is greatly facilitated by the sharp edge 118 and tapered portion 116 of tapered cutter guide 100. Absent this sharp edge 118 and tapered portion 116, the paper would be folded up and around the guide—resulting in a distortion of the fold and near certain misalignment of the paper template 104 as folded. In the alternative, the cutter guide would need to be removed and a separate and distinct additional guide, such as a thin card would need to be disposed along the first line 602 shown in FIG. 6. The use of an additional folding guide separate from the cutting guide leads to additional tools that the quilter must keep track of, and very likely increases the time of the project as the quilter must switch between tools repeatedly.

In FIG. 11 the tapered cutter guide 100 has been shown moved slightly backward so as to permit the folded portion 900 of paper template 104 to lay directly upon the paper template 104 and it is appreciated that the creased fold 1100 is smooth and aligned to the intended first line 602.

In FIGS. 12 and 13 the tapered cutter guide 100 is shown repositioned, this time with the inner guide edge 300 of the depending rail 108 against the creased fold 1100 of the paper template 104. At least a portion of the inner flat section 304 rests directly upon the folded paper template 104 and the outer edge 302 is disposed adjacent to the fabric 106 so as to guide a cutter. As the tapered section is disposed on the inside of the tapered cutter guide 100, the process of moving from the folding stage to the trimming stage simply involves a rolling motion.

In other words the tapered cutter guide 100 is slid out from the under the folded paper and rotated about it's longitudinal axis in a smooth motion to be ready for placement of the inner edge 300 of the rail against the folded crease of the paper. This simplicity of motion would not be achieved if the tapered section were disposed to adjoin the top section—a position that would require both rotation and flipping of the tapered cutter guide 100.

It is of course understood and appreciated that the figures as shown have been rendered for ease of discussion and illustration. Moreover, the paper when folded may be thin and thus the tapered cutter guide 100 may be slightly angled down and the outer cutting edge 302 in less than perpendicular alignment, which is fine. The folded paper is sufficient to catch the inner edge 300 and provide a stationary alignment of the tapered cutter guide 100.

Figure 14:
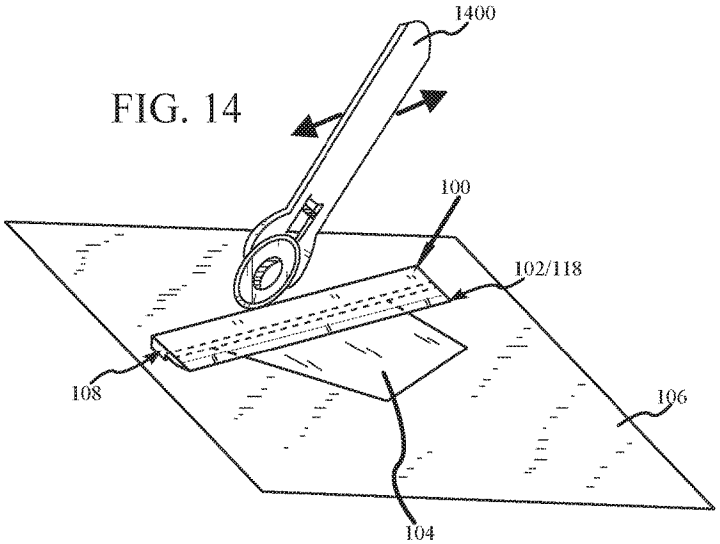
FIG. 14 is a perspective view showing the fabric cutting process with the tapered cutter guide in accordance with at least on embodiment.

As shown in FIG. 14 a cutter 1400, which in a preferred embodiment is a rotary cutter, is pushed or drawn along cutting edge provided by the outer cutting edge 302 of the tapered cutter guide 100 to cut the fabric 106. The cut out portion of fabric 106 then corresponds to at least a portion of Shape S 502 along the first line 602 with a sewing expanse corresponding to the width A 400 of the depending rail 108. This sewing expanse 1500 with width A 400 is more fully appreciated in FIGS. 15 and 16 providing top and side views. The trimmed section 1502 may be discarded or re-used to furnish yet another quilting piece if appropriate in size to another element of the template 104.

Figure 18:
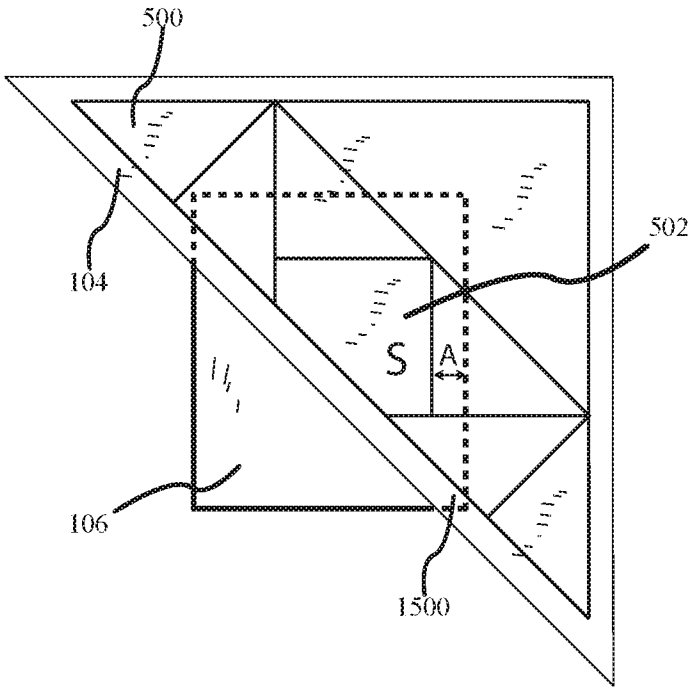
FIG. 18 is a top view showing the paper template unfolded and disposed upon the trimmed fabric piece ready for the selection of the next edge line for folding and trimming in accordance with at least on embodiment.
Figure 17:
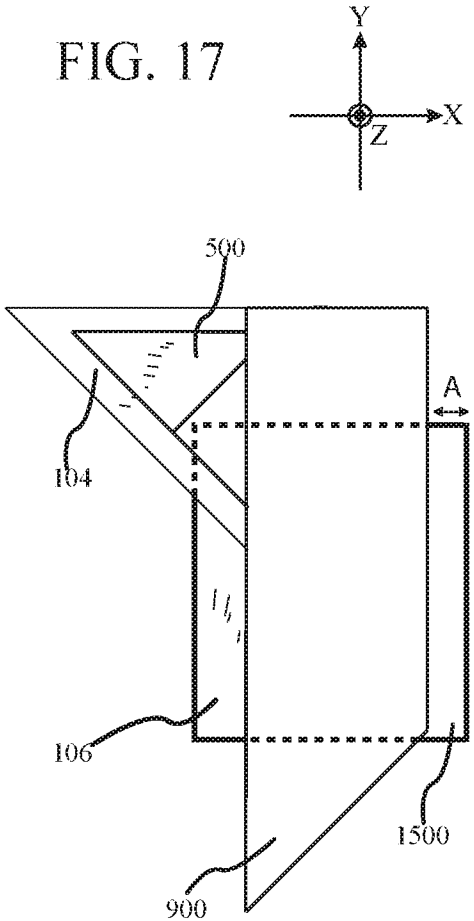
FIG. 17 is a top view showing the tapered cutter guide removed to shown the folded paper template disposed upon the trimmed fabric piece in accordance with at least on embodiment.

FIG. 17 shows the paper template 104 still folded but the tapered cutter guide 100 has been removed. In FIG. 18 the paper template 104 has been unfolded and the width A is again fully appreciated with respect to the first line of Shape S 502.

This process is then repeated for the other line elements of Shape S 502, such that after successive folds and cuts, the fabric 106 remaining is properly sized with a sewing expanse to Shape S 502.

Since quilting is a repetitive process, this same method and system are repeatedly applied to each of the other shapes as provided by the paper template 104, and indeed multiple paper templates 104 may be combined.

Moreover, with an embodiment of the present invention, a seamstress may quickly and easily prepare appropriately sized fabric 106 pieces for a paper piecing quilting project without having to measure and establish an offset from each line in the pattern to establish the proper sewing expanse, and as the same tool, specifically the tapered cutter guide 100, is used to establish the alignment crease and then the offset for the sewing expanse, the seamstress is not required to be continuously switching tools and tracking their whereabouts.

In light of the above discussion, for at least one embodiment a system for paper piecing incorporating a tapered cutter guide 100 may be summarized as including a quilt pattern 104 providing a plurality of geometric shapes 500, each shape 500 having straight sides and each shape 500 representing a quilting piece. The system further includes a tapered cutter guide 100 having: a depending rail 108 that is positioned along the first edge 112 of the cutter guide 100, the depending rail 108 having an inner guide edge 300 and an outer cutting edge 302 with the inner guide edge 300 and the outer cutting edge 302 being spaced apart in parallel relation by a width A 400 selected to correspond to a desired sewing expanse.

Tapered cutter guide 100 has a tapered section 116 along the second edge 114 to provide a sharp edge 118 of the cutter guide 100 opposite from the first edge 112, the tapering section 116 rising at an angle from the second edge 114, e.g. sharp edge 118 towards the inner guide edge 300; and a flat top section 306 between the first edge 112 and second edge 114, and a flat inner section 304 parallel to the top section 306 adjoining the inner edge 300 to the tapered section 116.

The system further includes a 1400 for cutting the fabric 106; wherein the flat top section 306 of the tapered cutter guide 100 is disposed upon the pattern 104 with the sharp edge 118 disposed along the straight edge of a selected shape, the pattern 104 folded about the sharp edge 118 to impart a crease 1100 along selected line of the selected shape; wherein the tapered cutter guide 100 is removed and the inner guide edge 300 of the tapered cutter guide 100 is positioned on, and in stationary relation to, the crease 1100 of the pattern 104; and wherein the cutter 1400 is moved along and is guided by the outer cutting edge 302 of the rail 108 to cut the fabric 106 into a quilting piece expanded in size by the desired sewing expanse.

In addition to a system for paper piecing incorporating the tapered cutter guide, the above description may also be summarized to set forth at least one method for quilting via paper piecing incorporating a tapered cutter guide 100. It will be appreciated that the method as presented above, and summarized below, need not be performed in the order in which it is herein described, but that this description is merely exemplary of one embodiment for one method for cutting fabric quilting pieces having an exposed area with a tapered cutter guide 100.

In general, the method will commence by disposing a quilt pattern 104 providing a plurality of geometric shapes 500 upon a piece of fabric 106, each shape 500 having straight sides and each shape 500 representing a quilting piece, the disposed pattern 104 aligning a selected geometric shape 502 to the piece of fabric 106. The method further includes providing a cutter 1400 for cutting the fabric 106.

In addition, and advantageously simplifying the process and number of tools required for paper piecing, the method also provides a tapered cutter guide 100 having: a depending rail 108 is positioned along the first edge 112 of the cutter guide 100, the depending rail 108 having an inner guide edge 300 and an outer cutting edge 302 with the inner guide edge 300 and the outer cutting edge 302 being spaced apart in parallel relation by a width A 400 selected to correspond to a desired sewing expanse.

Tapered cutter guide 100 has a tapered section 116 along the second edge 114 to provide a sharp edge 118 of the cutter guide 100 opposite from the first edge 112, the tapering section 116 rising at an angle from the second edge 114, e.g. sharp edge 118 towards the inner guide edge 300; and a flat top section 306 between the first edge 112 and second edge 114, and a flat inner section 304 parallel to the top section 306 adjoining the inner edge 300 to the tapered section 116.

The method proceeds by disposing the top flat section 304 of the tapered cutter guide 100 upon the pattern 104 with second edge 114, e.g. sharp edge 118 disposed along a selected line 602 of the selected shape 502, the pattern folded about the sharp edge to impart a crease along the selected line of the pattern. Following the fold and creasing, the tapered cutter guide 100 is removed and the inner guide edge 300 of the tapered cutter guide 100 is positioned on and in stationary relation to the creased fold 1100 of the pattern 104. Now, the cutter 1400 is moved along and is guided by the outer cutting edge 302 of the rail to cut the fabric into a quilting piece expanded in size by the desired sewing expanse.

Changes may be made in the above methods, systems and structures without departing from the scope hereof. It should thus be noted that the matter contained in the above description and/or shown in the accompanying drawings should be interpreted as illustrative and not in a limiting sense. Indeed many other embodiments are feasible and possible, as will be evident to one of ordinary skill in the art. The claims that follow are not limited by or to the embodiments discussed herein, but are limited solely by their terms and the Doctrine of Equivalents.

What is claimed is:

1. A method for cutting fabric quilting pieces having an exposed area with a tapered cutter guide, comprising:

disposing a quilt pattern providing a plurality of geometric shapes upon a piece of fabric, each shape having straight sides and each shape representing a quilting piece, the disposed pattern aligning a selected geometric shape to the piece of fabric;

providing a cutter for cutting the fabric;

providing a tapered cutter guide having:

a depending rail positioned along a first edge of the tapered cutter guide, the depending rail having an inner guide edge and an outer cutting edge with the inner guide edge and the outer cutting edge being spaced apart in parallel relation by a width selected to correspond to a desired sewing expanse;

a tapered section along a second sharp edge of the tapered cutter guide opposite the first edge, the tapering section rising at an angle from the sharp edge towards the inner guide edge; and a flat top section between the first and second edge, and a flat inner section parallel to the top section adjoining the inner edge to the tapering section;

wherein the flat top section of the tapered cutter guide is disposed upon the pattern with the sharp edge disposed along a selected line of the selected shape, the pattern folded about the sharp edge to impart a crease along the selected line of the pattern;

wherein the tapered cutter guide is removed and the inner guide edge of the tapered cutter guide is positioned on and in stationary relation to the crease of the pattern; and wherein the cutter is moved along and is guided by the outer cutting edge of the rail to cut the fabric into a quilting piece expanded in size by the desired sewing expanse.

2. The method of claim 1, wherein the tapered cutter guide is generally transparent.

3. The method of claim 1, wherein the tapered cutter guide is marked with standard measurement units.

4. The method of claim 1, wherein the tapered cutter guide further includes at least one magnifying section adjacent to the top section.

5. The method of claim 1, wherein at least a portion of the tapered cutter guide includes at least one textured area on the top surface and or the inner flat section and or the rail to provide a friction hold upon paper or fabric.

6. The method of claim 1, wherein at least a portion of the tapered cutter guide includes at least one textured area on the top surface and or the inner flat section and or the rail to assist with being placed by an operator's hand upon paper or fabric.

7. The method of claim 1, wherein the transition of the tapered cutter guide from the pattern folded about the sharp edge to the inner edge of the tapered cutter guide being positioned against the crease is accomplished by rotating the tapered cutter guide about a longitudinal axis.

8. A tapered cutter guide for use in cutting quilting pieces and paper piecing, comprising:

a generally rectangular body having a long first edge and opposite thereto a long second edge;

a depending rail positioned along the first edge of the tapered cutter guide, the rail having an inner guide edge and an outer cutting edge with the inner guide edge and the outer cutting edge being spaced apart in parallel relation by a width selected to correspond to a desired sewing expanse;

a tapered section along the second edge to provide a sharp edge of the tapered cutter guide opposite from the first edge, the tapered section rising at an acute angle from the sharp edge towards the inner guide edge;

a flat top section between the first and second edge, and a flat inner section parallel to the top section adjoining the inner edge to the tapering section; and the depending rail being transparent.

9. The tapered cutter guide of claim 8, wherein the width selected to correspond to a desired sewing expanse is between about one-sixteenth of an inch and three-quarters of an inch.

10. The tapered cutter guide of claim 8, wherein the tapered cutter guide is generally transparent.

11. The tapered cutter guide of claim 8, wherein the tapered cutter guide is marked with standard measurement units.

12. The tapered cutter guide of claim 8, wherein the tapered cutter guide further includes at least one magnifying section adjacent to the top section.

13. The tapered cutter guide of claim 8, wherein at least a portion of the tapered cutter guide includes at least one textured area on the top surface and or the inner flat section and or the rail to provide a friction hold upon paper or fabric.

14. The tapered cutter guide of claim 8, wherein at least a portion of the tapered cutter guide includes at least one textured area on the top surface and or the inner flat section and or the rail to assist with being placed by an operators hand upon paper or fabric.

15. The tapered cutter guide of claim 8, wherein the tapered cutter guide includes a hole for storage by hanging.

16. A system for cutting fabric quilting pieces having an exposed area with a tapered cutter guide, the system comprising:

a quilt pattern providing a plurality of geometric shapes, each shape having straight sides and each shape representing a quilting piece;

a tapered cutter guide having:

a depending rail positioned along a first edge of the tapered cutter guide, the depending rail having an inner guide edge and an outer cutting edge with the inner guide edge and the outer cutting edge being spaced apart in parallel relation by a width selected to correspond to a desired sewing expanse;

a tapered section along a second sharp edge of the tapered cutter guide opposite from the first edge, the tapering section rising at an angle from the sharp edge towards the inner guide edge; and a flat top section between the first and second edge, and a flat inner section parallel to the top section adjoining the inner edge to the tapering section; and the depending rail being transparent; and a cutter for cutting the fabric;

wherein the flat top section of the tapered cutter guide is disposed upon the pattern with the sharp edge disposed along the selected line of the selected shape, the pattern folded about the sharp edge to impart a crease along the selected line of the pattern;

wherein the tapered cutter guide is removed and the inner guide edge of the tapered cutter guide is positioned on, and in stationary relation to, the crease of the pattern; and wherein the cutter is moved along and is guided by the outer cutting edge of the rail to cut the fabric into a quilting piece expanded in size by the desired sewing expanse.

17. The system of claim 16, wherein the tapered cutter guide is generally transparent.

18. The system of claim 16, wherein the tapered cutter guide is marked with standard measurement units.

19. The system of claim 16, wherein the width selected to correspond to a desired sewing expanse is between about one-sixteenth of an inch and three-quarters of an inch tapered cutter guide further includes at least one magnifying section adjacent to the top section.

20. The system of claim 16, wherein at least a portion of the tapered cutter guide includes at least one textured area on the top surface and or the inner flat section and or the rail to provide a friction hold upon paper or fabric.

21. The system of claim 16, wherein at least a portion of the tapered cutter guide includes at least one textured area on the top surface and or the inner flat section and or the rail to assist with being placed by an operators hand upon paper or fabric.

22. The system of claim 16, wherein the tapered cutter guide includes a hole for storage by hanging.

* * * * *